US006201508B1

(12) United States Patent
Metzen et al.

(10) Patent No.: US 6,201,508 B1
(45) Date of Patent: Mar. 13, 2001

(54) INJECTION-MOLDED PHASED ARRAY ANTENNA SYSTEM

(75) Inventors: Phillip L. Metzen, Foster City; Richmond D. Bruno, San Jose; Terry M. Smith, La Honda, all of CA (US)

(73) Assignee: Space Systems/Loral, Inc., Palo Alto, CA (US)

( * ) Notice: Subject to any disclaimer, the term of this patent is extended or adjusted under 35 U.S.C. 154(b) by 0 days.

(21) Appl. No.: 09/459,695

(22) Filed: Dec. 13, 1999

(51) Int. Cl.[7] ..... H01Q 21/00; H01Q 13/00

(52) U.S. Cl. ..... 343/778; 343/776; 343/786; 343/853

(58) Field of Search ..... 343/853, 776, 343/778, 786; 342/371, 372, 375; H01Q 21/00, 13/00

(56) References Cited

U.S. PATENT DOCUMENTS

| | | | | |
|---|---|---|---|---|
| 4,527,165 | * | 7/1985 | De Ronde | 343/778 |
| 5,517,203 | * | 5/1996 | Fiedziuszko | 343/776 |
| 5,623,269 | * | 4/1997 | Hirshfield et al. | 342/371 |
| 5,886,671 | * | 3/1999 | Riemer et al. | 343/776 |
| 5,977,910 | * | 11/1999 | Matthews | 342/372 |
| 5,995,062 | * | 11/1999 | Denney et al. | 343/853 |

* cited by examiner

*Primary Examiner*—Don Wong
*Assistant Examiner*—Hoang Nguyen
(74) *Attorney, Agent, or Firm*—Kenneth W. Float

(57) ABSTRACT

An injection molded phased array antenna system such as may advantageously employed on satellites. The antenna system comprises a plurality of metal plated, injection molded plastic horn radiating elements respectively coupled to a plurality of metal plated, injection molded plastic orthomode junctions that produce a corresponding plurality of vertically and horizontally polarized outputs. A metal plated, injection molded plastic vertical and horizontal beamforming networks is coupled to outputs of the plurality of orthomode junctions that establish unique phases and amplitudes that produce two separate outputs associated with two independent beams. The beamforming networks each comprise a plurality of metal plated, injection molded plastic fixed phase shifters respectively coupled to outputs of the plurality of orthomode junctions, a plurality of metal plated, injection molded plastic two-way power combiner-divider networks coupled to adjacent ones of the phase shifters, a plurality of metal plated, injection molded plastic eight-way power combiner-divider networks coupled to the two-way power combiner-divider networks by way of an intermediate structural panel, and a plurality of metal plated, injection molded plastic four-way power combiner-divider networks coupled to the eight-way power combiners by way of a main structural panel. The four-way power combiner-divider networks produce respective vertical and horizontal polarized outputs of the antenna system.

17 Claims, 10 Drawing Sheets

RADIATING ELEMENTS
HORN/OMJ
PHASE SHIFTERS
256 HORIZONTAL
256 VERTICAL
1X2 POWER COMBINERS
128 HORIZONTAL
128 VERTICAL
1X8 POWER COMBINERS
16 HORIZONTAL
16 VERTICAL
1X4 POWER COMBINERS
4 HORIZONTAL
4 VERTICAL
1X4 POWER COMBINERS
1 HORIZONTAL
1 VERTICAL
HORIZONTAL OUTPUT
VERTICAL OUTPUT
10
11
12, 13
14
15
16
17
18
19
1
2
255
256
H
V

INJECTION-MOLDED PHASED ARRAY ANTENNA SYSTEM

BACKGROUND

The present invention relates generally to satellites, and more particularly, to a low cost, injection molded phased array antenna system that may advantageously be used on satellites.

In addition to lower costs and shorter delivery schedules, the current trend in synchronous orbit satellites and satellite antennas is to provide more power and more payload capability, including more independent antenna beams. Satellite antennas while meeting other requirements must be low cost, quickly produced and mount to available spacecraft mounting locations. Also, the spacecraft with antennas and solar arrays must fit within the shroud of the launch vehicle. Spacecraft mounting space and shroud volume are limited, and larger launch vehicles with larger shrouds are costly.

Transmit and receive functions are often separated into two antennas, each covering a narrow bandwidth, resulting in a reduction in transmit feed system losses and an improvement in antenna beam shape optimization efficiency. Improved transmit antenna performance reduces the high costs associated with supplying more solar array DC power, traveling wave tube amplifier (TWTA) RF power, and thermal control.

A deployed shaped-reflector antenna is frequently used to satisfy transmit requirements and an earth facing, deck-mounted reflector antenna is used to satisfy receive functions. An earth deck structure is necessary to hold the receive antenna reflector, subreflector and RF feed. At Ku-band, the projected aperture of the earth deck antenna diameter is typically 1.2 meters. The reflector, subreflector and structure are made of graphite composite materials.

It would therefore be advantageous to have an improved phased array antenna system which may be used on satellites that improves upon conventional antennas.

SUMMARY OF THE INVENTION

The present invention provides for an injection molded phased array antenna system that may advantageously be used on satellites. The phased array antenna system comprises a plurality of metal plated, injection molded plastic waveguide components. A reduced-to-practice embodiment of the phased array antenna system includes five injection molded plastic components, some of which require no secondary machining, while some require minimal secondary machining.

More particularly, the phased array antenna system comprises a plurality of metal plated, injected-molded radiation elements that include a plurality of metal plated, injected-molded horn radiating elements. A plurality of metal plated, injected-molded orthomode junctions are respectively coupled to the horn radiating elements. A crossed septum is preferably disposed in the radiating aperture of each horn radiating elements that equalizes E and H-plane radiation and increases radiating element gain. A noncontacting through port septum and a side port septum are disposed in each of the orthomode junctions. 90 degree E- and H-plane waveguides are coupled to appropriate side ports of the orthomode junctions. Vertical and horizontal metal plated, injected-molded phase shifters are coupled to each of the plurality of orthomode junctions.

A metal plated, injected-molded power combiner-divider network comprising a plurality of cascaded vertical polarization and horizontal polarization power combiner-divider elements is coupled to outputs of the phase shifters and to outputs of the 90 degree E- and H-plane waveguides. Each power combiner-divider network is split along the broadwall of the waveguide and is riveted together. This method of constructing the power combiner-divider networks makes them relatively insensitive to perturbations. The broadwall split block technique used to produce the power combiner-divider networks allow accurate injection molding without electrical performance degradation.

A plurality of subassemblies are produced that comprise a pair of horns and orthomode junctions, a pair of two-way power combiners and four phase shifters interconnected using spring clips are coupled to a plurality of eight-way power combiner-divider networks and are secured together using an intermediate structural panel. The assembled plurality of subassemblies are coupled to sets of four-way power combiner-divider networks for each polarization and secured together using a main structural panel. Each set of four-way power combiner-divider networks respectively produces vertical and horizontal polarized outputs of the antenna system.

Near net dimensional, injection molding is used to reduce the required machining of the various components to a minimum. The phased array antenna system uses waveguide slip joints, snap together features, and clips for ease of assembly. The phased array antenna system has lighter weight, is produced at lower cost, with quicker fabrication and assembly, than conventional comparably performing antennas.

The use of the injected-molded components produces a densely packed package that is a physically small array. The use of the injected-molded components reduces or shortens lengths of waveguide runs and therefore reduces the insertion loss of the phased array antenna system. The slip joints allow components to slide or snap together. This eliminates fasteners and is less sensitive to alignment, and allows the use of clips for ease of assembly.

BRIEF DESCRIPTION OF THE DRAWINGS

The various features and advantages of the present invention may be more readily understood with reference to the following detailed description taken in conjunction with the accompanying drawings wherein like reference numerals designate like structural elements, and in which.

DETAILED DESCRIPTION

Figure 1:
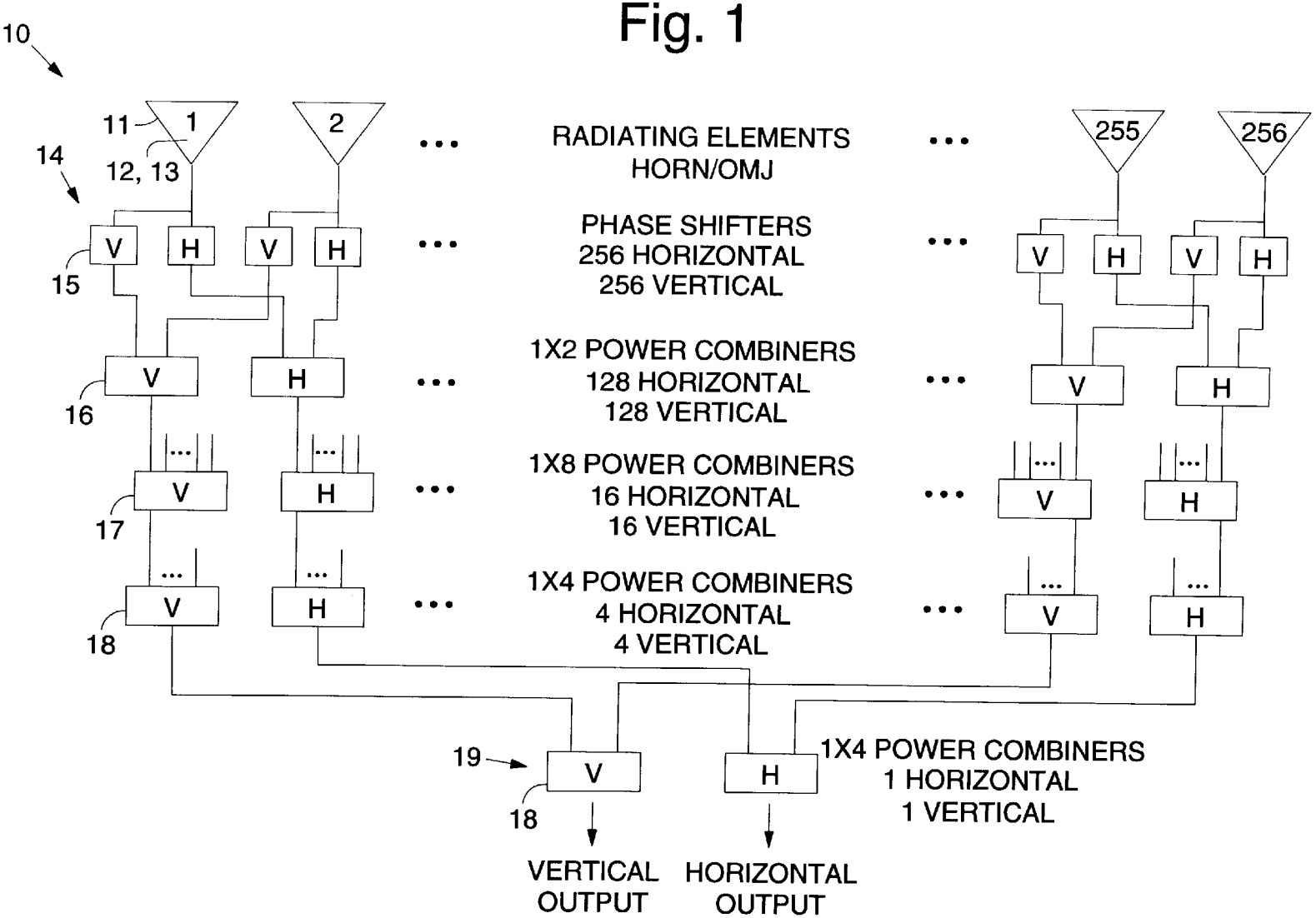
FIG. 1 is a system block diagram illustrating an exemplary injection molded phased array antenna system in accordance with the principles of the present invention.
Figure 2:
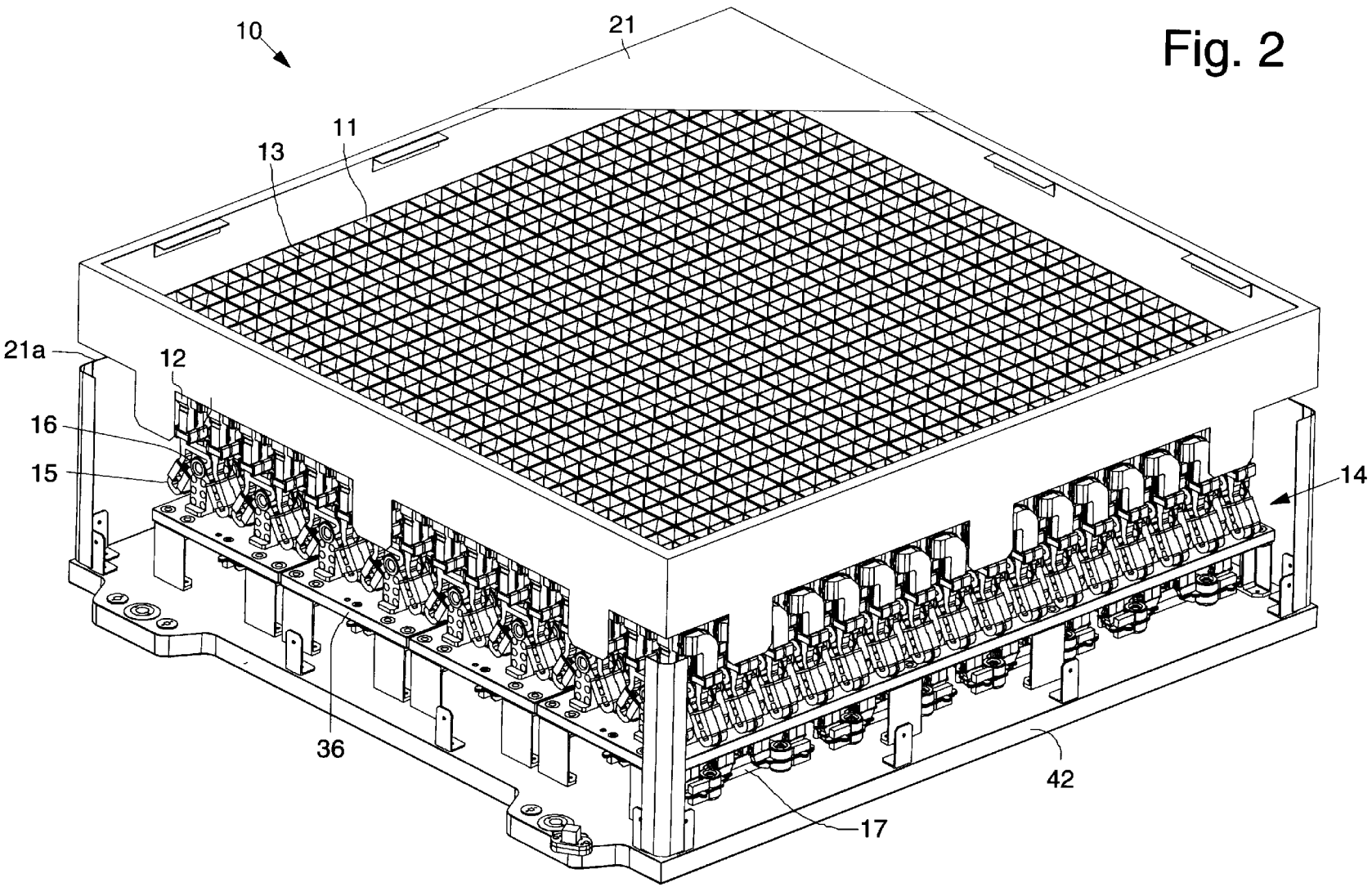
FIG. 2 illustrates a perspective view of a fully-assembled system that has been reduced to practice with the aperture cover and aperture cover support panels removed.

Referring to the drawing figures, FIG. 1 illustrates a system block diagram of an exemplary passive array antenna system 10 in accordance with the principles of the present invention. The passive array antenna system 10 illustrated in FIG. 1 has been reduced-to-practice and a perspective view of a fully assembled system 10 is shown in FIG. 2. The reduced-to-practice embodiment of the passive array antenna system 10 comprises a 256 element passive direct radiating receive array operating from 13.75 GHz to 14.5 GHz with a two wavelength element spacing. The system 10 has the equivalent RF performance of a conventional 1.2 meter Gregorian dual polarized shaped reflector antenna.

The exemplary passive array antenna system 10 comprises 256 horn radiating elements 11, or horns 11. Each of the 256 horn radiating elements 11 is integrated with an orthomode junction 12 that produces 256 vertically and 256 horizontally polarized outputs. Each of the horn radiating elements 11 also contains a crossed septum 13 in its aperture to increase the directivity and improve E-plane and H-plane equalization.

Separate beamforming networks 14 for each (vertical and horizontal) polarization are used to establish the unique phase and amplitudes necessary to produce two separate outputs associated with two independent beams of any desired shape. Due to the substantial similarity of the vertically and horizontally polarized beamforming networks 14, only the horizontally polarized beamforming network 14 will be described.

The horizontally polarized output produced by each horn 11 and orthomode junction 12 passes through a predetermined fixed phase shifter 15 and is combined with the horizontally polarized output produced by a neighboring horn 11, orthomode junction 12 and phase shifter 15 in one of 128, two-way power combiner-divider networks 16. The 128 outputs of the two-way power combiner-divider networks 16 are then combined by sixteen eight-way power combiner-divider networks 17, resulting in sixteen outputs that are combined by five four-way power combiner-divider networks 18 to produce a single, horizontally polarized output.

Each eight-way power combiner-divider network 17 is comprised of four two-way power combiner-divider networks 16, and each four-way power combiner-divider network 18 is comprised of two two-way power combiner-divider networks 16, for a total of 255 two-way power combiner-divider networks 16 in each vertically and horizontally polarized beamforming network 14. Each two-way power combiner-divider network 16 has a predetermined, fixed, output power ratio which along with the phase shifters 15 uniquely determine any desired output beam shape.

In the antennas system 10, the RF beamforming networks 14 are designed to yield a "generic" part when they are injection molded. Each "generic" molded beamforming network 14 become "unique" after a desired power division ratio is computer numerically controlled (CNC) machined into each hybrid ring power combiner-divider network 16, 17, 18. By molding "near net shape" parts, the economy of using high volume, low cost manufacturing methods (i.e., injection molding and CNC machining) is realized. Secondary machining operations are minimal, but allow great design flexibility for specific antenna applications and all RF components. Net shape phase shifters 15 can be quickly and easily "snapped" in place to change or set desired characteristics.

Table 1 presents a calculated loss budget and edge-of-coverage (EOC) gain for an exemplary reduced-to-practice antenna system 10 (shown in FIG. 2) designed to produce typical contiguous United States (CONUS) coverage. The beamforming network 14 of the reduced-to-practice antenna system 10 was constructed in WR62 and half weight WR62 waveguide operating in the $TE_{11}$ mode and uses U-shaped waveguide phase shifters 15 and internally terminated hybrid ring power combiner-divider networks 16, 17, 18. The RF performance of each component was computer optimized and then verified with aluminum models. An aperture cover 21 (FIG. 5) used in the reduced-to-practice antenna system 10 may be replaced by a three-layer meanderline polarizer 21*b* (FIG. 5) with an added 0.1 dB of loss if circular polarization is desired.

TABLE 1

| Edge of coverage gain | |
|---|---|
| CONUS coverage edge of coverage directivity | |
| Rectangular horn | 31.0 dB |
| Crossed septum | 0.5 dB |
| Total directivity | 31.5 dB |
| Array antenna losses | |
| Mismatch loss | 0.2 |
| Insertion loss | 0.4 |
| Aperture cover loss | 0.1 |
| total loss | 0.7 |
| Antenna EOC gain | 30.8 |

The mechanical and manufacturing design of the passive array antenna system 10 will now be discussed. To significantly lower the cost of the finished system 10, metallized, injection-molded fiber reinforced thermoplastic waveguide components are used for the horn radiating elements 11, phase shifters 15 and power combiner-divider networks 16, 17, 18. The material used in the reduced-to-practice embodiment of the passive array antennas system 10 has excellent physical and thermal properties, produces highly repeatable components, and is lightweight and easy to machine.

Good metallization along with straightforward injection molding, is assured by splitting the power combiner-divider networks 16, 17, 18 along the waveguide broadwall axis exposing their inside surfaces. The power combiner-divider networks 16, 17, 18 are designed and molded to near net shape and are then lightly machined in "ring" areas 28 to predetermined fixed power ratios using high speed CNC machining. Internal RF loads 26 (FIGS. 6*a*, 6*b*) for the power combiner-divider networks 16, 17, 18 are molded to net shape and hold-in-place features allow them to be captured when installed in the power combiner-divider networks 16, 17, 18. Injection molding to net and near net shape allows all components to be produced in quantity for a relatively low cost and placed in inventory in advance of their need, thus reducing the delivery time for a finished antenna array system 10.

Ease of assembly, integration and test has been considered in the design of the passive array antenna system 10. Along with minimizing parts count where possible, flanges are eliminated, waveguide slip-joints 33 (FIG. 3,) are used, and threaded fasteners are replaced by clips 23 (FIG. 3) and lock-in place features 24. Where threaded fasteners are required, light-weight composite versions are used. Excess material has been designed out of the injection-molded pieces and interlocking, self-jigging features have been used.

The injection-molding tools used to make the components were constructed from three-dimensional computer-aided-design (CAD) file models of the injection-molded components. The CAD files were verified using stereo-lithography models.

FIG. 2 illustrates a perspective view of a fully-assembled passive array antenna system 10 with its aperture cover 21 and aperture cover support panels 21*a* removed on two sides for clarity. The fully-assembled reduced-to-practice system 10 is 0.84 meters by 0.76 meters in cross-section and 0.37 meters in height and weighs 28.7 Kg.

Figure 3:
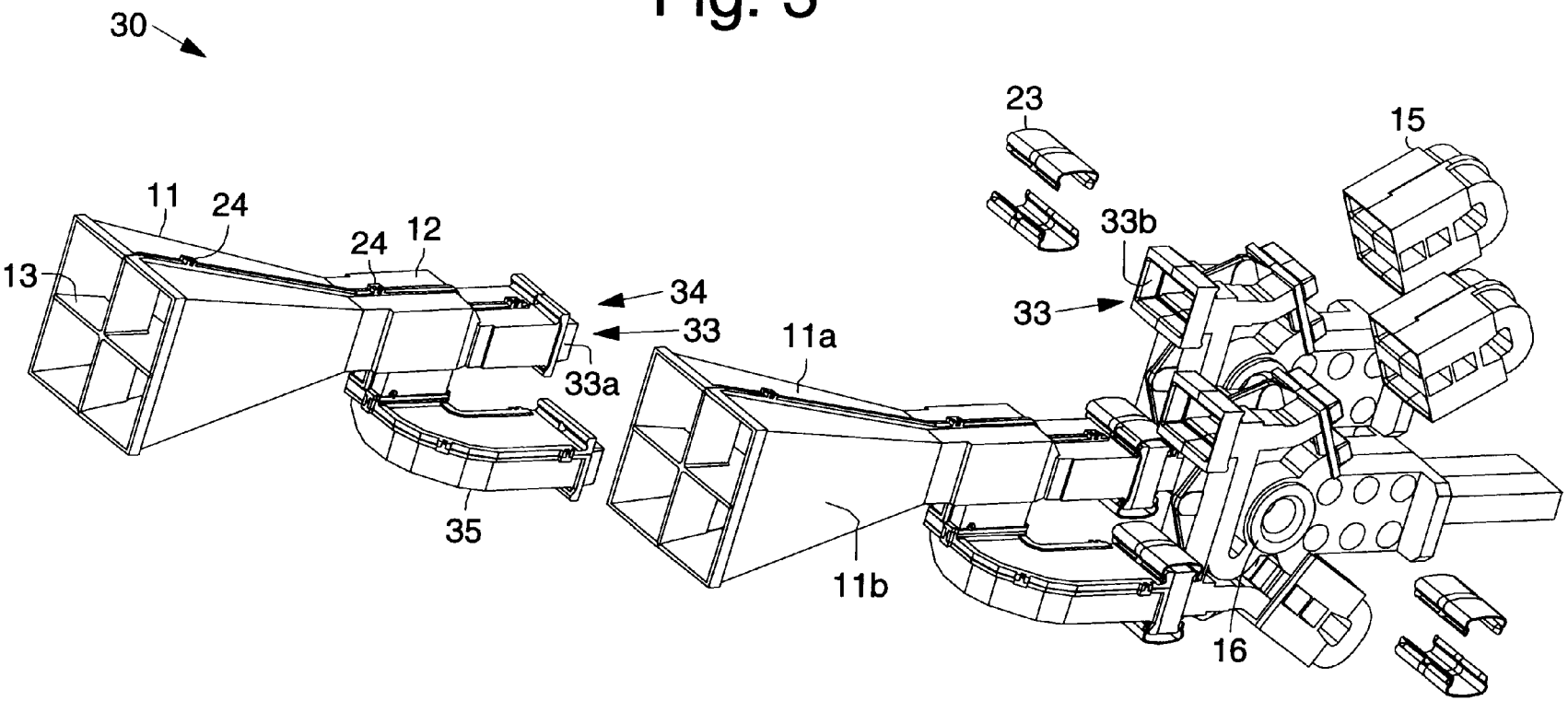
FIG. 3 illustrates a partially exploded view of an assembly including a pair of horn/orthomode junction assemblies, a pair of two-way power combiner-divider networks and four phase shifters interconnected using spring clips.

FIG. 3 illustrates a partially exploded perspective view of an assembly 30 comprising a pair of horns 11 and orthomode junctions 12, a pair of two-way power combiner-divider networks 16 and four phase shifters 15 interconnected using Beryllium copper spring clips 23. This assembly 30 is a simple building block, and, when repeated a predetermined number of times, forms a major portion of the antenna system 10.

Figure 3A:
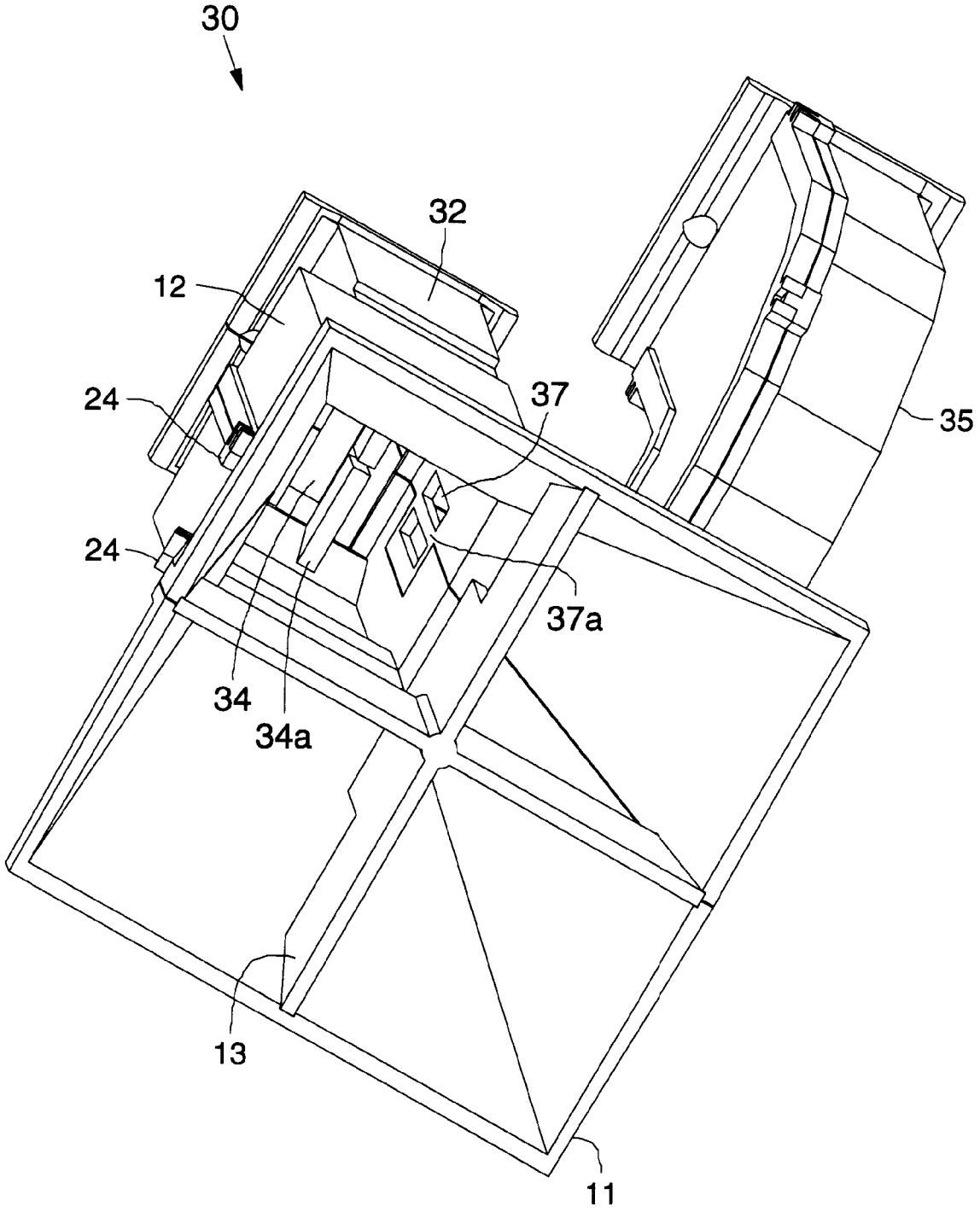
FIG. 3*a* is a front perspective view of a portion of the assembly shown in FIG. 3.

FIG. 3*a* is a front perspective view of a portion of the assembly 30 shown in FIG. 3. The orthomode junctions 12 are coupled to ports 31 of the two-way power combiner-divider networks 16 by way of sections of straight waveguide 32 comprising the through ports 34 that have male waveguide slip joints 33*a* at their ends. The side ports 37 of the orthomode junctions 12 are coupled to ports 31 of the two-way power combiner-divider networks 16 by way of 90 degree E- and H-plane waveguides 35. The 90 degree E- and H-plane waveguides 35 also have male waveguide slip joints 33*a* at their ends. The male waveguide slip joints 33*a* connect to female slip joints 33*b* at the inputs of the two-way power combiner-divider networks 16.

FIG. 3*a* illustrates the interior of the horn 11 and shows the cross septum 13 disposed in the aperture of the horn. A noncontacting through port septum 34*a* is disposed at the junction of the horn 11 and a through port 34 of the orthomode junction 12. FIG. 3*a* also shows a side port septum 37*a* formed in the sidewall at a side port 37 of the orthomode junction 12. FIGS. 3 and 3*a* more clearly show the alignment features 24 used on the horns 11, orthomode junctions 12, the straight waveguides 32, and the 90 degree E- and H-plane waveguides 35.

The phase shifters 15 are set to predetermined values between 0° to 360° by CNC machining material from their open ends to produce the proper length and are easily interchanged to produce a desired phase distribution. Each horn 11 and orthomode junction 12 are each injection molded in two pieces and the cross septum 13 is injection molded in one piece. The five pieces comprising the horn 11 and orthomode junction 12 are bonded together with structural adhesive and then plated with electroless copper to produce a finished subassembly.

The 90 degree E- and H-plane waveguides 35 are injection molded in two pieces in two pieces that are bonded together with structural adhesive and then plated with electroless copper to produce a finished subassembly. The assembled 90 degree E- and H-plane waveguides 35 are bonded to the side port of the 37 of the orthomode junction 12.

The phase shifters 15 and all versions of the power combiner-divider networks 16, 17, 18 are each molded in two pieces. After machining, electroless plating, and insertion of RF loads 26 in the power combiner-divider networks 16, 17, 18, the two pieces are joined together using molded-in self-aligning features and mechanically fastened with rivets 32 (FIGS. 6*a*, 6*b*, 7) disposed through tabs of the components.

Figure 4:
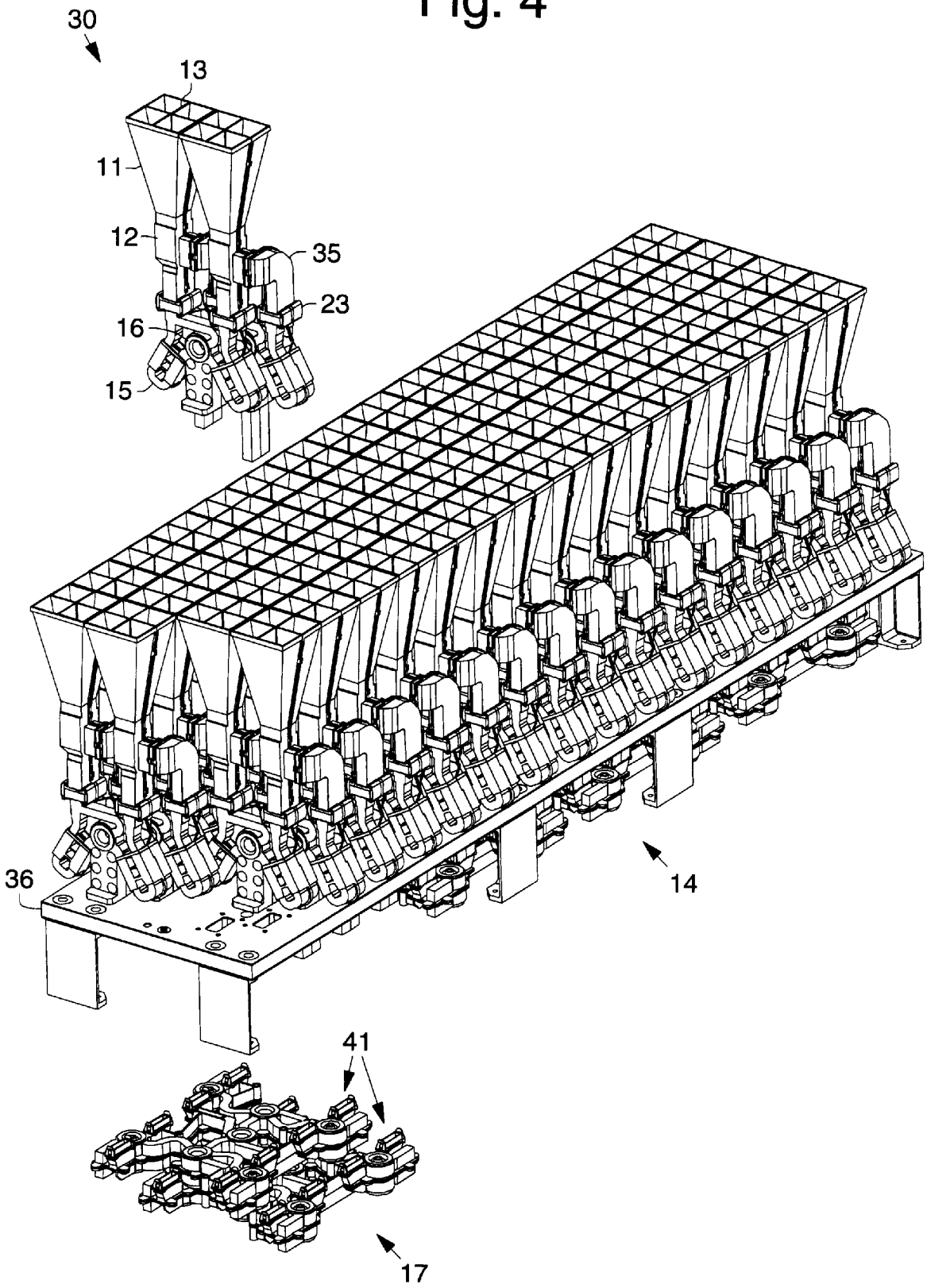
FIG. 4 illustrates a 4×16 element sub-array assembly of the system of FIG. 1.

FIG. 4 illustrates a 4×16 element subarray assembly 30 formed by fastening thirty-two assemblies 30 comprising two horns 11, two orthomode junctions 12, four phase shifters 15 and two two-way power combiner-divider networks 16 to an intermediate structural panel 36. Outputs of the two-way power combiner-divider networks 16 pass through the intermediate structural panel 36 and slip into input ports 41 of four horizontally polarized and four vertically polarized eight-way power combiner-divider networks 17. The eight-way power combiner-divider networks 17 are fastened to the underside of the structural panel 36 and are offset with respect to each other for proper waveguide alignment. Details of the eight-way power combiner-divider networks 17 are shown and described with reference to FIGS. 6*a* and 6*b*.

Figure 5:
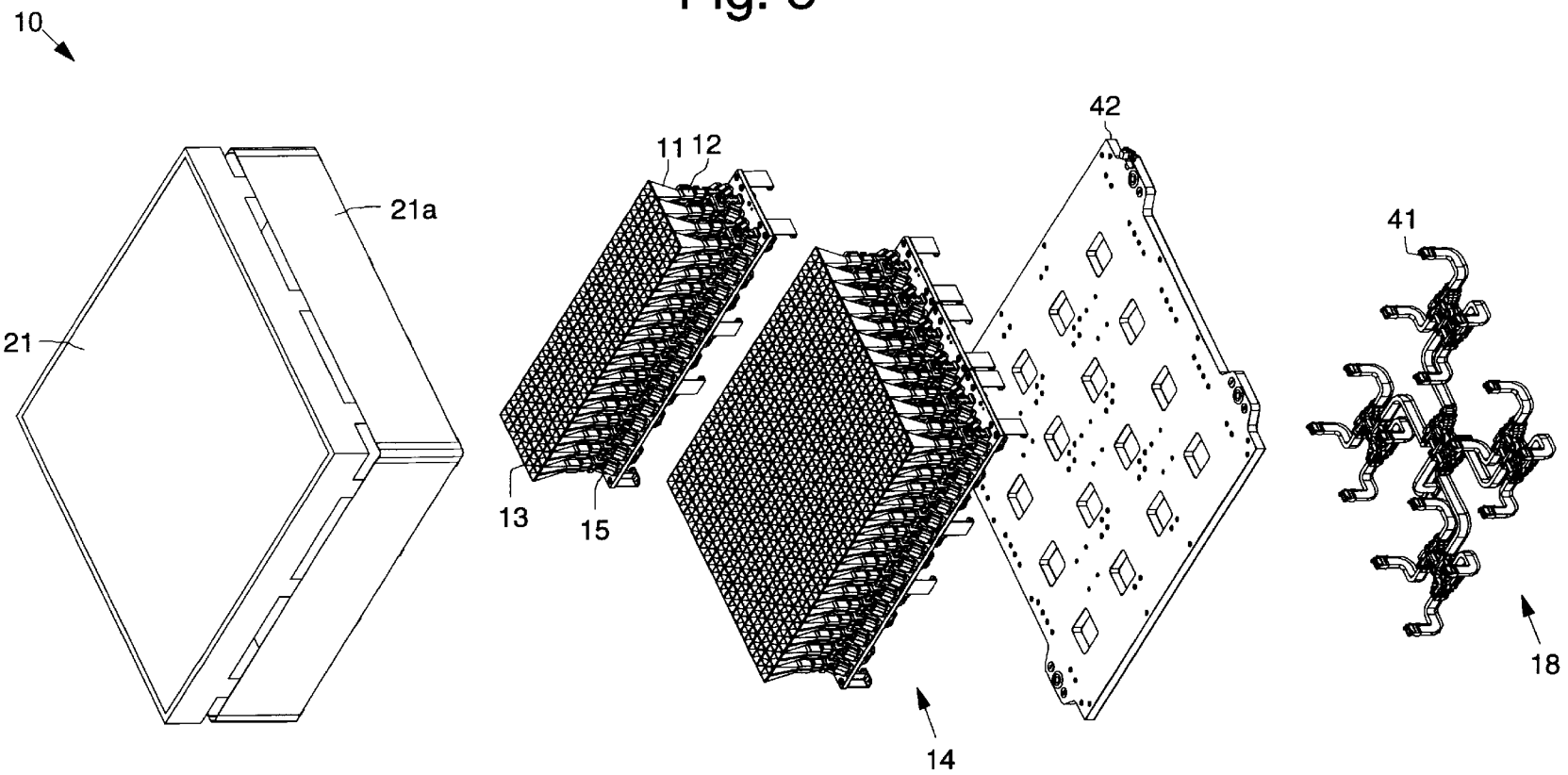
FIG. 5 illustrates an exploded view of the system of FIG. 1.

FIG. 5 illustrates an exploded view of the passive array antenna system 10. Four 4×16 element subarray assemblies 30 (FIG. 4) are fastened to a main structural panel 42. Two output power combiner/divider networks 19 are fastened to the underside of the structural panel 42. For clarity, only one of two output combiner-divider networks 19, which are a subset of five two-way power combiner-divider networks 18, is shown. The second output combiner-divider network 19 is offset from and passes through the one that is shown in FIG. 5.

Sixteen interconnecting waveguide input ports 43 pass through the structural panel 42 and slip into eight horizontally polarized and eight vertically polarized output ports 44 (FIG. 4) of the eight-way power combiner-divider networks 17. On the underside of the middle pair of the four-way power combiner-divider networks 18, are one horizontally polarized and one vertically polarized output ports (not shown). Fastening the aperture cover 21 and side panels 21*a* to the support panel 42 completes the passive array antenna system 10. The aperture cover 21 may be replaced by a three-layer meanderline polarizer 21*b* with an added 0.1 dB of loss if circular polarization is desired.

Figure 6B:
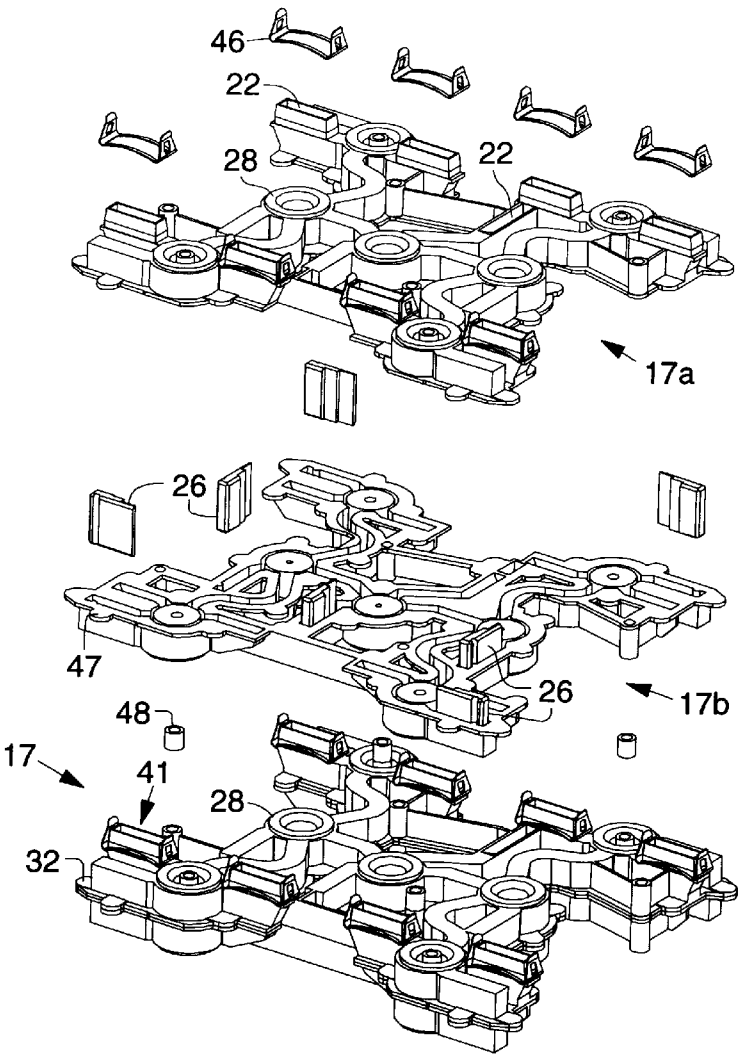
FIGS. 6*a* and 6*b* illustrate an embodiment of a one by eight power combiner-divider network employed in the system of FIG. 1.
Figure 6A:
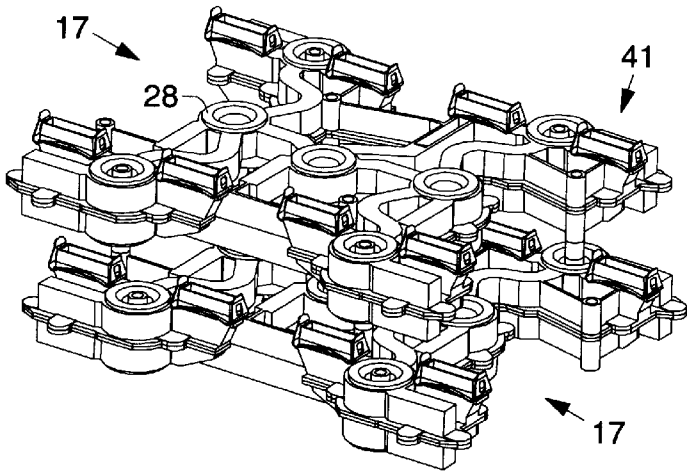
Figure 7:
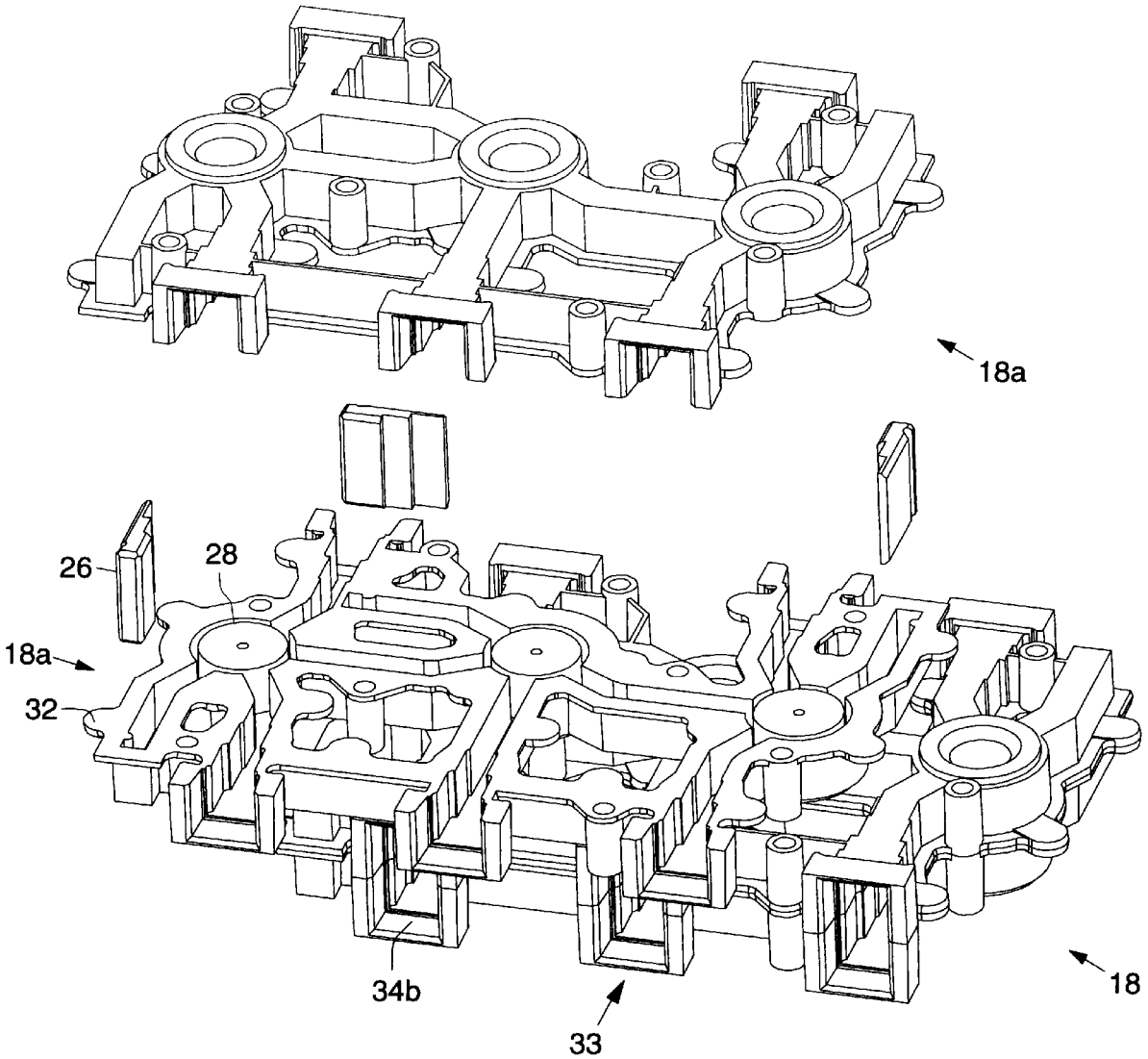
FIG. 7 illustrates a partially exploded view of a typical near-net four-way power combiner-divider network.
Figure 8:
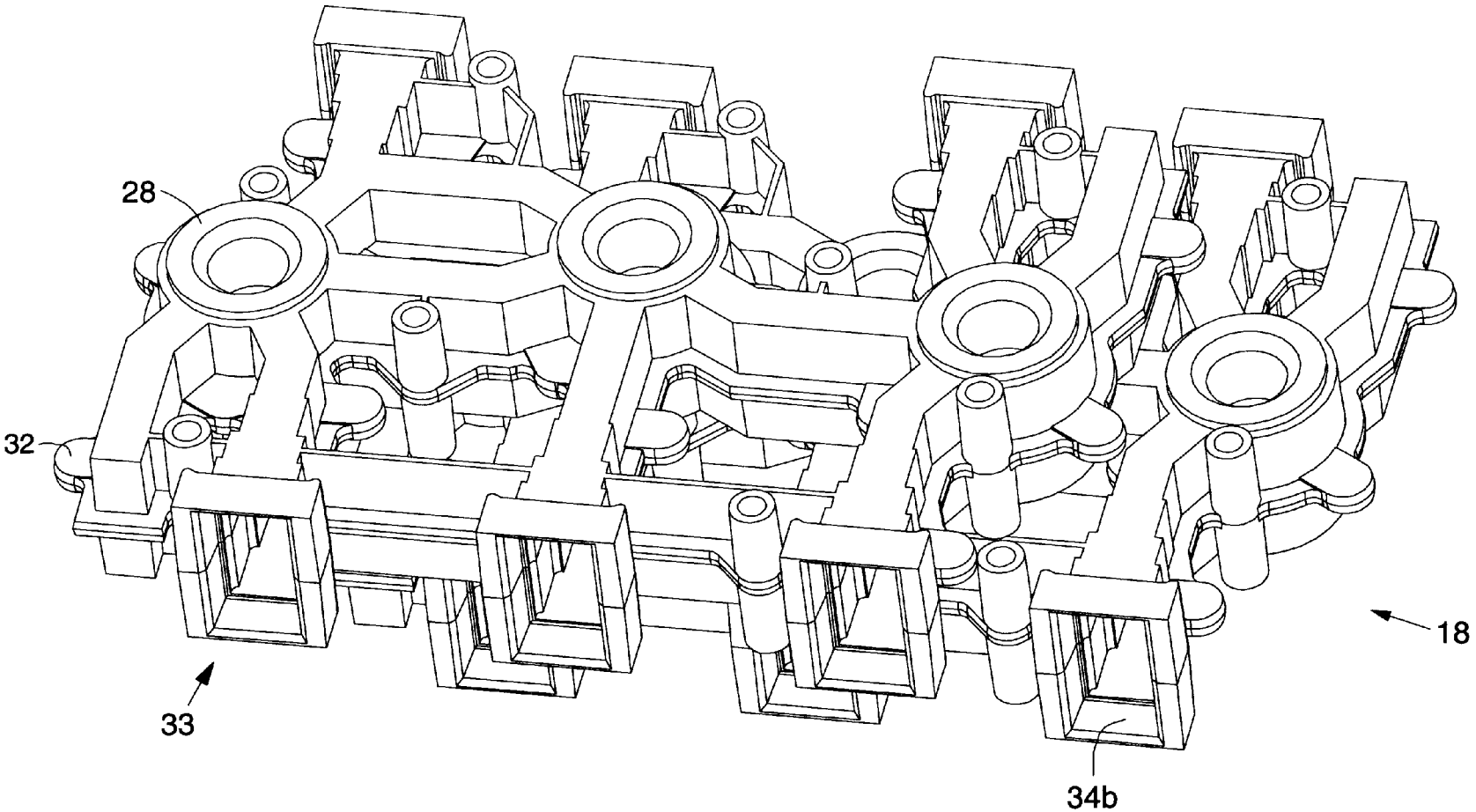
FIG. 8 illustrates an isometric view of two fully-assembled nested four-way power combiner-divider networks.
Figure 9:
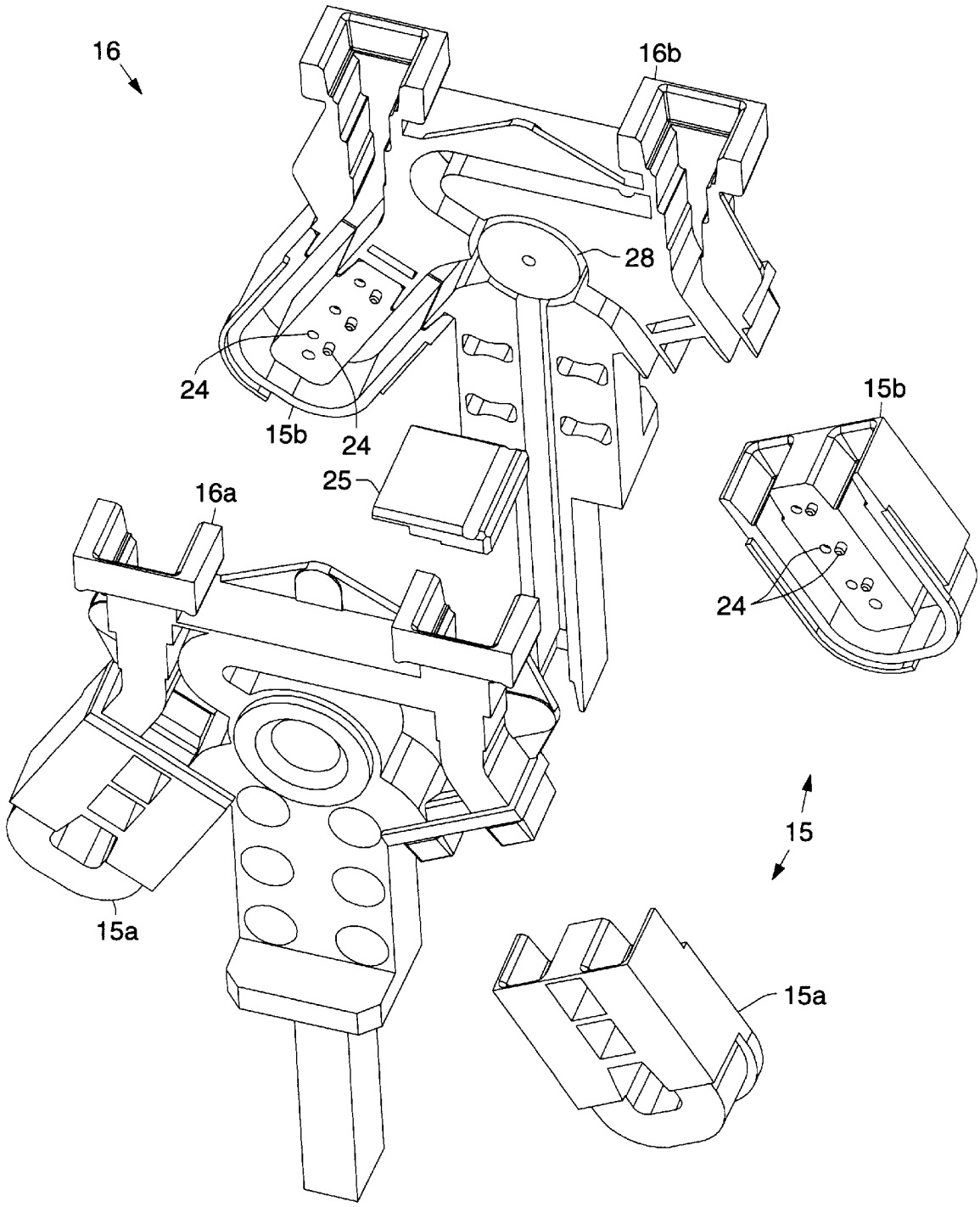
FIG. 9 is an exploded view of a two-way power combiner-divider network.

FIGS. 6*a*, 6*b*, 7, 8 and 9 illustrate details of the power combiner-divider networks 16, 17, 18 used in the antenna system 10. More particularly, FIGS. 6*a* and 6*b* illustrate details of exemplary embodiment of the eight-way power combiner-divider networks 17 employed in the antenna array system 10 of FIG. 1. FIG. 6*a* shows a fully-assembled pair of the eight-way power combiner-divider network 17. FIG. 6*b* shows an exploded view of the horizontal eight-way power combiner-divider network 17 with an assembled vertical eight-way power combiner-divider network 17 disposed below it. FIG. 7 illustrates a partially exploded view of a typical near-net four-way power combiner-divider network 18. FIG. 8 illustrates an isometric view of two fully-assembled nested four-way power combiner-divider networks 18. FIG. 9 is an exploded view of a two-way power combiner-divider network 16.

Each eight-way power combiner-divider network 17 is molded in two halves 17*a*, 17*b* to near net shape and divided along its broadwall axis. Light machining is required in hybrid ring areas 28 of the respective hybrid ring power combiner-divider networks 17 to produce predetermined, fixed, output power ratio. After machining, both halves 17*a*, 17*b* are plated with electroless copper. RF loads 26 are molded to net shape including self capture features 48 and are inserted into the bottom half each the eight-way power combiner-divider network 17. The two halves 17*a*, 17*b* are joined using molded-in alignment features 24 and held in place with mechanical rivets 32. Copper grounding clips 46 are installed to ensure good electrical connection to the other components in the completed system 10. With the exception of the grounding clips 46, the two-way and four-way power combiner-divider networks 16, 18 are similarly designed, produced, plated and assembled.

Similarly, Each two- and four-way power combiner-divider network 16, 18 is molded in two halves 16*a*, 16*b* , 18*a*, 18*b* to near net shape and divided along its broadwall axis. Light machining is required in hybrid ring areas 28 of the respective hybrid ring power combiner-divider networks 16, 18 to produce predetermined, fixed, output power ratio. After machining, the respective halves 16*a*, 16*b*, 18*a*, 18*b* are plated with electroless copper. RF loads 26 are molded to net shape including and are inserted into the bottom half each the power combiner-divider network 16, 18. The respective halves 16*a*, 16*b*, 18*a*, 18*b* are joined using molded-in alignment features 24 and held in place with mechanical rivets 32. Copper grounding clips 46 are installed.

As is shown in FIG. 9, the phase shifters 15 are sections of U-shaped plastic waveguide whose waveguide length is fixed. The phase shifters 15 are set to predetermined values between 0° and 360° by machining material from their open (flat) ends to produce the proper length. The ring area 28 of the two-way power combiner-divider network 16 that are lightly machined to predetermined fixed power ratios is more clearly shown in FIG. 9.

From the above, it should be understood that the present invention provides a novel method for producing very low cost and lightweight phased array satellite antennas systems 10 using injection moldable, lightweight thermoplastic composite materials. The antenna system 10 comprises an assembly of microwave components that are injection molded to "net" and "near net" shape that are subsequently plated and assembled, or bonded, plated and assembled to form RF antenna components. These components have all of the required internal physical features molded to final proportions such as proper waveguide height and width dimensions, tuning stubs, septum, transformation sections, coupling slots, filter cavities, and the like, to effect the desired RF performance.

With reference to FIG. 3, in the case of the horn and orthomode junction assembly, the two RF components (tapered horn 11 and orthogonal mode transformer or junction 12) are integrated into one unit, minimizing unnecessary, heavy and expensive flanges and hardware. The horn and orthomode junction assembly includes four molded plastic parts that are easily assembled using unique internal alignment and fixturing features molded into the parts.

The horn and orthomode junction assembly is molded in two halves 11*a*, 11*b* (FIG. 3) that has a precision molded joint in the mating surfaces designed to support an adhesive structural bond, joining the halves 11*a*, 11*b* together. One half 11*a* has a continuous raised triangular cross section along the perimeter of the part. On the mating piece, a corresponding triangular shaped grove is molded. During assembly, adhesive is applied to the grooved surface. A flat spatula is used to screed the adhesive in the groove leaving the exact volume of bonding material. The dimensions of the mating ridge and the groove are such that when assembled the exact volume of adhesive is squeezed into the bond joint producing the desired bond line thickness without excess squeeze-out of the adhesive. The dimensions of the mating features, when assembled, are designed to displace the exact amount of adhesive to form the bond line of predetermined thickness.

The two mating surfaces are uniquely designed to form a uniform and reliable bondline joint when assembled. A suitable structural adhesive is applied into the groove. A spatula is used to screed the adhesive, removing all of the material except what's left in the groove. The groove has been designed to hold the exact amount of bonding adhesive necessary to securely bond the two halves together.

Interlocking pins and slots register the two halves 11*a,* and 11*b* in the desired location and provides the necessary physical displacement between the parts to secure a uniform bond line thickness, and provide the necessary fixturing to hold the parts together during the cure cycle. The two 90 degree elbows 35 are bonded to the horn 11 using similar fixturing techniques. The horn and orthomode junction assembly is then chemically and/or mechanically cleaned and plated using the desired metal coatings to the required thickness. When using gold flash as the final metal coating, no further finishing processes are required.

Generic ring hybrid networks 16, 17, 18 (hybrid ring power combiner-divider networks 16, 17, 18) are molded to "near net" shape in the desired physical arrangement. The hybrid ring dimensions are molded in such a manner that a minimum amount of material is molded to accommodate a range of power division/combinations ratios. Once the specific power division relations have been specified, simple machining operations performed on the generic networks customize them, making each unique. After machining and part marking, the networks 16, 17, 18 are plated (with the desired metal coatings for RF purposes) RF loads 26 are installed and the two halves are joined. Fastening techniques include rivets 32, chemical bonding agents, thermal welding, ultrasonic welding, or other snap or interlocking features. Snap interlocking techniques are used to minimize installation time, reduce mechanical fastener count and simplify integration of individual RF components. Snap features are designed with hooks and loops molded as an integral parts of the RF components or may be separate components. Each network 16, 17, 18 is molded, machined, plated and assembled using the same methods.

In order to facilitate rapid yet accurate integration of RF subassemblies, special RF/mechanical joints are used. The joints are designed as male/female slip joints 33 that plug together and are secured using clips and springs or integral snap features. The design allows rapid yet accurate hand assembly eliminating costly alignment fixtures, hard to access traditional screws and inserts, nut and washers. The assembly is lightweight due to minimizing, or eliminating traditional hardware and flanges.

Each horn output (two in the disclosed embodiment, horizontal and vertical polarization) requires a waveguide element that is manufactured to a specific length, used to provide a desired RF phase length for that output port. The phase shifter 15 is molded in two halves 15*a*, 15*b* (FIG. 9), split along the broad wall of the waveguide with integral inter locking alignment features. The two halves 15*a*, 15*b* are molded net lengths forming the longest of a family of phase shifters 15 that are required. The ports are marked, plated using desired metal coatings and fastened together. The desired phase shift for each port is manufactured from the generically molded plastic pieces, plated, assembled and clipped to the desired RF port. If another phase length is desired the phase shifter 15 is easily removed and replaced using a premanufactured "clip" locking feature.

A generic molded plastic power combiner-divider network 16, 17, 18 is designed to operate over a range of power division ratios by substituting the required septum before molding. Each power combiner-divider network 16, 17, 18 is molded in two halves, split along the broadwall of the waveguide, as is shown in FIGS. 6*b*, 7 and 9. The mold is designed to accept a range of inserts used to achieve specific power divisions. The number of power combiner-divider network 16, 17, 18 and their ratios is predetermined based on a statistical analysis. Once determined, the required number of specific ratios power combiner-divider networks 16, 17, 18 are molded. The design is such that surfaces of the septum 34*a* are noncontacting along the broad wall of the waveguide. After plating a resistive load is easily assembled to the septum 34*a* and the two halves joined together forming a unique microwave power combiner-divider network element. The combination of these elements in any desired combination of power division ratios is easily achieved by interconnections.

The bond line joints used in producing components of the antenna system 10 employ interconnecting features that are designed to meter a prescribed amount of bond material. A flange RF choke provides a PIM free connection between flanges and the broadwall. Snap features include the use of beryllium copper (Be—Cu) clips and plastic snaps. Generic RF manifolds are molded and then slightly modified using numerically controlled machining to produce application specific antennas.

The reduced-to-practice embodiment of the present invention provides for an improved earth deck mounted passive array antenna system 10 that has the same RF performance and the same mass as a previously used 1.2 meter reflector antenna, costs 75 percent less, occupies 80 percent less earth deck area and 95 percent less shroud volume than the previously used Gregorian antenna. The passive array antenna system 10 has a lower center of gravity than the previously used antenna for improved spacecraft inertial characteristics.

Thus, an improved injection molded phased array antenna system such as may be used on satellites has been disclosed. It is to be understood that the described embodiments are merely illustrative of some of the many specific embodiments that represent applications of the principles of the present invention. Clearly, numerous and other arrangements can be readily devised by those skilled in the art without departing from the scope of the invention.

What is claimed is:

1. A phased array antenna system comprising:

a plurality of metal plated, injection molded plastic horn radiating elements;

a plurality of metal plated, injection molded plastic orthomode junctions respectively coupled to the plurality of horn radiating elements that produce a corresponding plurality of vertically and horizontally polarized outputs;

metal plated, injection molded plastic vertical and horizontal beamforming networks respectively coupled to outputs of the plurality of orthomode junctions that establish unique phases and amplitudes that produce two separate outputs associated with two independent beams, and that each comprise:

a plurality of metal plated, injection molded plastic fixed phase shifters respectively coupled to outputs of the plurality of orthomode junctions;

a plurality of metal plated, injection molded plastic two-way power combiner-divider networks coupled to adjacent ones of the phase shifters;

a plurality of metal plated, injection molded plastic eight-way power combiner-divider networks coupled to the two-way power combiners by way of an intermediate structural panel; and a plurality of metal plated, injection molded plastic four-way power combiner-divider networks coupled to the eight-way power combiners by way of a main structural panel that produces respective vertical and horizontal polarized outputs of the antenna system.

2. The system in claim 1 wherein the eight-way power combiner-divider networks are comprised of four two-way power combiner-divider networks.

3. The system recited in claim 2 wherein the four-way power combiner-divider networks are comprised of two two-way power combiner-divider networks.

4. The system recited in claim 1 wherein each two-way power combiner-divider network has a predetermined, fixed, output power ratio which along with the phase shifters uniquely determine any desired output beam shape.

5. The system recited in claim 1 wherein each of the horn radiating elements comprises a cross septum disposed in its aperture.

6. The system recited in claim 1 wherein each of the orthomode junctions comprise a noncontacting through port septum disposed adjacent a through port thereof, and a side port septum formed in the sidewall at a side port thereof.

7. The system recited in claim 6 wherein the orthomode junctions are coupled to ports of the two-way power combiner-divider networks using straight waveguides comprising the through ports.

8. The system recited in claim 7 wherein the power combiner-divider networks and straight waveguides comprise waveguide slip joints at their respective ends that couple them together.

9. The system recited in claim 7 wherein the side ports of the orthomode junctions are coupled to ports of the two-way power combiners using 90 degree E- and H-plane waveguides.

10. The system recited in claim 9 wherein the power combiner-divider networks and 90 degree E- and H-plane waveguides comprise waveguide slip joints at their ends.

11. The system recited in claim 1 wherein the phase shifters are set to predetermined values between 0° and 360° by machining material from their open ends to produce a desired length.

12. The system recited in claim 1 wherein the eight-way power combiner-divider networks comprise RF loads.

13. The system recited in claim 1 wherein the respective power combiner-divider networks are joined together using molded-in self-aligning features and are mechanically fastened with rivets.

14. The system recited in claim 1 further comprising an aperture cover and side panels coupled to the support panel.

15. The system recited in claim 1 wherein the four-way hybrid ring power combiner-divider networks are machined in hybrid ring areas to produce predetermined, fixed, output power ratios.

16. The system recited in claim 1 wherein the eight-way power combiner-divider networks comprise self capture features.

17. The system recited in claim 1 further comprising conductive grounding clips coupled to the power combiner-divider networks to ensure electrical connection.

* * * * *